US005833138A

United States Patent [19]

Crane et al.

[11] Patent Number: 5,833,138

[45] Date of Patent: Nov. 10, 1998

[54] MULTI MODE SHOWER HEAD

[75] Inventors: Jeremy Lewis Crane, St. Lawrence; Christopher John Samwell, Bushby, both of Great Britain

[73] Assignee: Newteam Limited, Great Britain

[21] Appl. No.: 637,814

[22] PCT Filed: Nov. 4, 1994

[86] PCT No.: PCT/GB94/02430

§ 371 Date: Aug. 19, 1996

§ 102(e) Date: Aug. 19, 1996

[87] PCT Pub. No.: WO95/12456

PCT Pub. Date: May 11, 1995

[30] Foreign Application Priority Data

Nov. 6, 1993 [GB] United Kingdom ..... 9322901
May 18, 1994 [GB] United Kingdom ..... 9409864

[51] Int. Cl.[6] ..... B05B 15/02

[52] U.S. Cl. ..... 239/106; 239/117; 239/123; 239/525

[58] Field of Search ..... 239/104, 106, 239/114–117, 123, 525–6

[56] References Cited

U.S. PATENT DOCUMENTS

| | | | |
|---|---|---|---|
| 881,842 | 3/1908 | Bender | 239/116 |
| 1,236,617 | 8/1917 | Speakman | 239/117 |
| 1,982,538 | 11/1934 | Reedy | 239/117 |
| 2,251,192 | 7/1941 | Krumseik et al. | 239/117 |
| 4,018,385 | 4/1977 | Bruno | 239/381 |
| 4,330,089 | 5/1982 | Finkbeiner | 239/383 |
| 4,838,486 | 6/1989 | Finkbeiner | 239/117 |

*Primary Examiner*—Andres Kashnikow
*Assistant Examiner*—Lisa Ann Douglas
*Attorney, Agent, or Firm*—Frijouf, Rust & Pyle, P.A.

[57] ABSTRACT

A cartridge (2) secured for angular movement on the handset head (10) has a valve-like cooperation with openings (12) in the head (10) for water flow via passageways (20, 21, 22) in the cartridge (2) to showering outlets (30, 31, 32) on appropriate rotational setting of the cartridge (2). Cleaning pins (7) rotatable with the cartridge (2) and co-axially movable relative to it are operated by a cam track (8, 81) to penetrate fine spray outlets (32) to clean them of scale. The cam co-action of the pin ring followers (71) with the track (8) causes the pins (7) to remain inoperative during the showering modes but the pins (7) are operated for penetration by further turning of the cartridge (2) i.e. independently of the showering modes. The followers (71) are spring urged against the track (8) such as by resilient blades (75) bearing against the taper periphery (27) of the cartridge (2). Clearance pin penetration of the outlets (32) permits water flow to wash away scale and minimize back pressure. Angular movement of the cartridge (2) is limited by stops (83, 84) and showering settings are located by cam track recesses (82).

12 Claims, 4 Drawing Sheets

FOAMING MODE

PULSE MODE

SPRAY MODE

CLEANING

MULTI MODE SHOWER HEAD

This invention relates to multi-mode shower heads usually in the form of handsets and in which provision is included for effecting cleaning of fine outlet perforations which otherwise tend to become blocked or restricted with lime scale or other clogging matter.

Thus EP-A-0 284 801 (Grohe) discloses a multi mode shower head having a series of outlet cleaning pins which are cam operated for cleaning operation between each showering mode in an automatic manner so that each time there is a change of showering mode the pins are operated to effect outlet cleaning. Whereas an automatic cleaning action is obtained, excessive operation and wear of the pin mechanism may occur.

The object of the invention is to provide a multi-mode shower head or handset in which cleaning of fine outlet perforations can be readily effected as and when required. Practical advantages of the invention in this and other respects including constructional features will be apparent from the following description.

According to this invention a multi-mode shower head or handset in which a body member or cartridge is secured for relative angular movement to the head and has a valve like cooperation (at 12) with the hollow interior of the head for directing water flow from the head via passageways in the cartridge to arrangements of showering mode outlet openings including fine spray outlet openings at the front face of the cartridge, the showering modes from said outlets being selected by turning the cartridge to appropriate settings on the head, and a series of cleaning pins are rotatable with the cartridge and co-axially movable relative thereto for cleaning penetration into corresponding fine spray outlet openings and withdrawal therefrom; is characterised in this that the cleaning pins are operated for such co-axial movement by follower means to the series of cleaning pins which cooperates with a cam formation or track within the head, the cam co-action being such that the cleaning pins remain inoperative during any of the showering mode settings of the cartridge and are only independently operated by the cam formation or track by further turning movement of the cartridge beyond the showering mode settings.

Practical examples of shower handsets embodying the invention are shown in the accompanying drawings in which.

Like parts are referred to by the same or similar reference numerals through the drawings.

Figure 1:
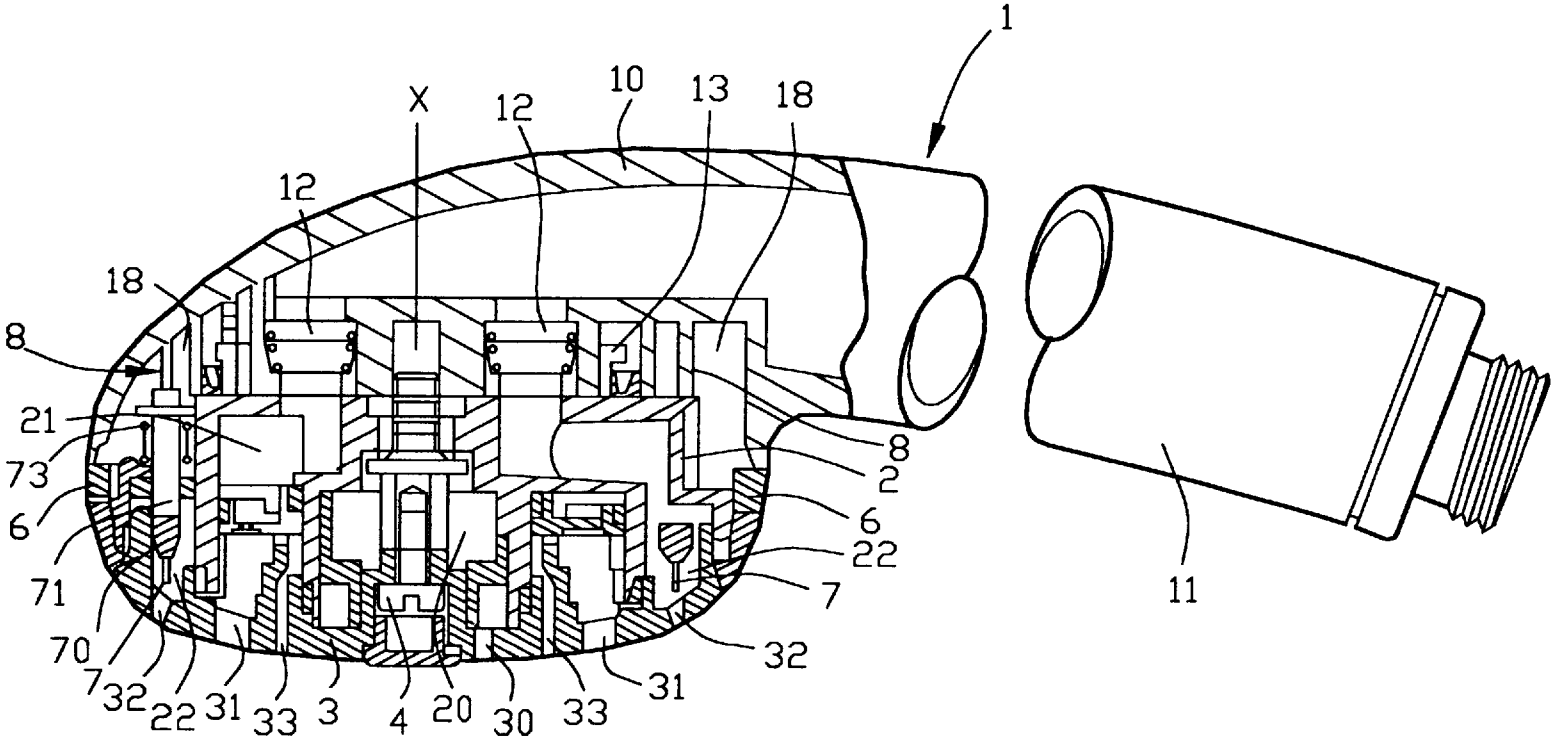
FIG. 1 is a side elevation of the handset of which the head portion is in section to reveal the internal mechanism shown in a shower mode.
Figure 2:
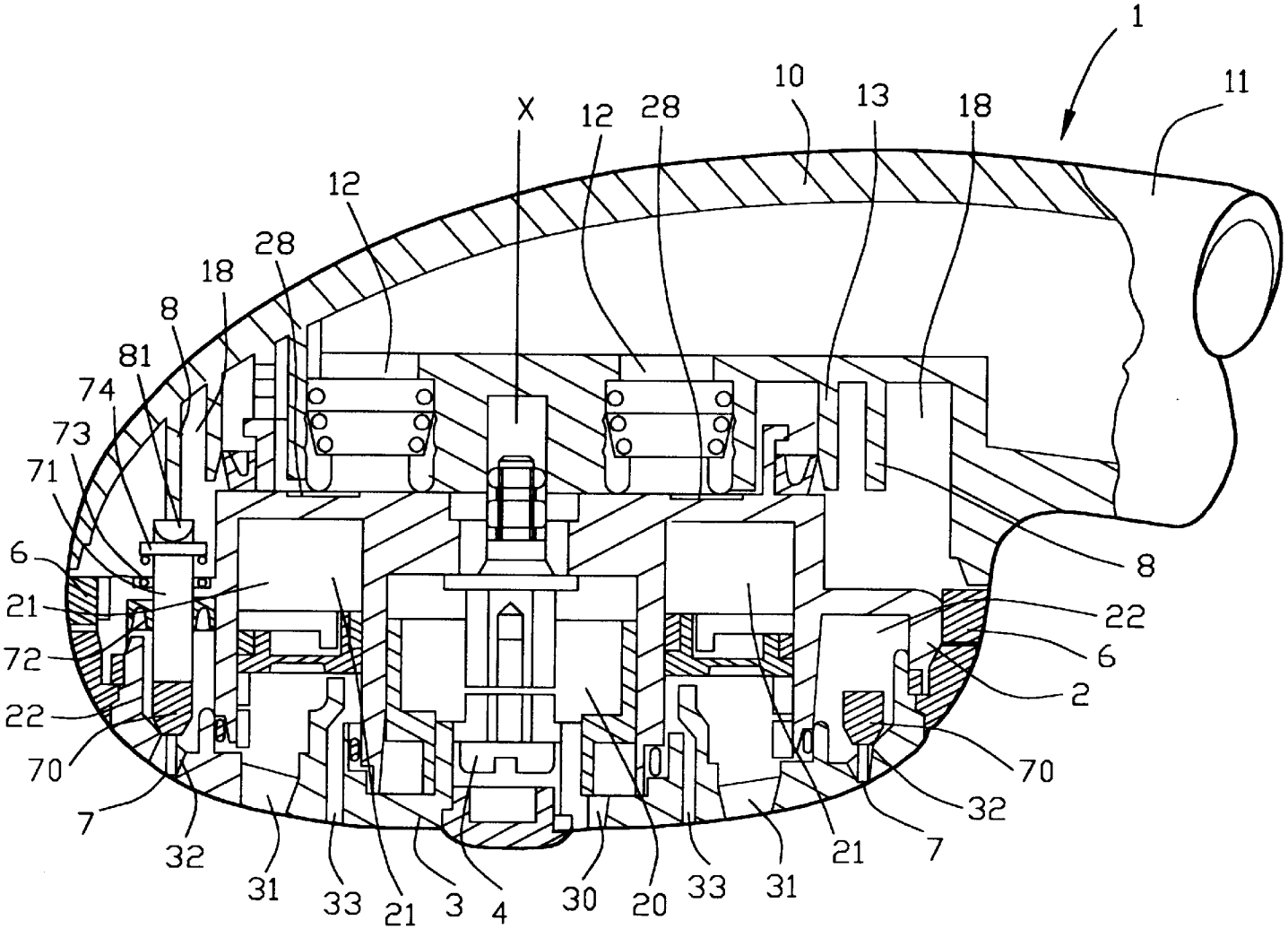
FIG. 2 is a sectional view of the head portion on an enlarged scale with the mechanism shown in the cleaning condition.

In the example of the handset now described with reference to FIGS. 1 to 6 it provides three showering or spraying modes, namely a central pulsing emission, or an inner annular aerated or "champagne" emission, or an outer annular fine spray emission. The number, nature, arrangement and sequence of the modes may be varied according to requirements and the mechanism and its showering operation are of generally known form as follows:

Referring in particular to FIG. 2 water under pressure is admitted along the tubular neck or handle 11 of the handset 1 into the head portion 10 where it enters openings 12 in a partition 13 across the interior of the head portion 10. Accommodated between the partition 13 and a front face member or plate 3 is a body member or cartridge 2 which is angularly movable about the central axis X so as to have a valve like cooperation with the openings 12 in relation to passageways in the cartridge 2 and outlets in the face plate 3. The face plate 3 and cartridge 2 are fast with one another and can be together turned about a central securing bolt 4 on the axis X by means of a gripping ring or bezel 6 fast with and about the cartridge 2. On angular setting of the cartridge 2 and face plate 3 to the pulse mode position water from the openings 12 is directed to an annular chamber 20 in the cartridge 2 for emission from outlet openings or slots 30 through the face plate 3, which openings 30 are centrally arranged in an annular manner on a common circle about the axis X. Only one opening 30 is visible in FIGS. 1 and 2.

In the aerated or "champagne" setting of the cartridge 2 and face plate 3 water from the openings 12 is directed to an annular chamber 21 for passing the water to corresponding outlet openings 31 in the face plate 3 again arranged in an annular manner about the axis X and pulse mode outlets 30. The passage of water to the outlet openings 31 is such as to draw in air from the front of the face plate 3 through ducts 33 alongside the outlets 31, which air intermingles with the water to provide an effervescent emission of water from the outlets 31 in the "champagne" mode.

In the third or fine spray mode the angular setting of the cartridge 2 and face plate 3 is such as to direct water from the openings 12 via an annular chamber 22 to an annular arrangement or outer ring of fine perforations 32 in the face plate 3. A considerable number of such perforations 32 is provided for effecting a fine spray and which may have a massaging effect.

Owing to their fine nature the perforations 32 tend to become blocked or restricted mainly by lime scale deposit from the water, especially hot water, and/or by any particles or other clogging matter in the water supply.

In view of this and according to the present invention an improved cleaning pin arrangement is provided for the perforations 32 and which is operable by the user as and when required by further turning of the cartridge 2 and face plate 3 beyond the above described showering mode settings.

Each pin 7 is aligned with a corresponding perforation 32 and in the operative penetrating position has a close fit in the perforation 32 to dislodge and expel any scale or the like from it in maintaining a satisfactory water spray.

The series of pins 7 are carried by a ring 70 accommodated in the annular chamber 22 in the cartridge 2 and projections or follower posts 71 extending from the rear of the ring 70 co-operate with an annular cam track or profile 8 integral with, or otherwise carried by, the interior of the head portion 10 in an annular space 18 about the cartridge 2. The space 18 does not receive water apart from any leakage which may have a lubricating effect.

The posts 71 (e.g. three) are equi-spaced on the ring 70 and each extend through a seal 72 into the space 18 for co-operation with the cam track 8. Each post 71 is spring urged such as by a compression spring 73 into contact with the cam track 8 and in a direction tending to withdraw the pins 7 from the perforations 32. Each compression spring 73 is shown acting between an adjacent part of the cartridge 2 and a circular clip 75 about the post 71.

Figure 3:
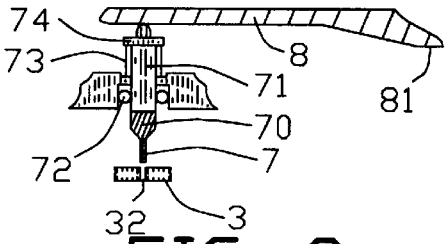
FIGS. 3 to 6 are diagrammatic detail elevational views showing the inoperative and operative conditions of one of the cleaning pins.
Figure 4:
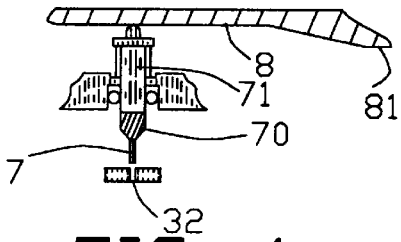
Figure 5:
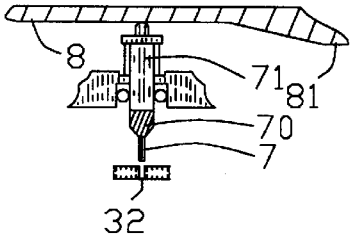
Figure 6:
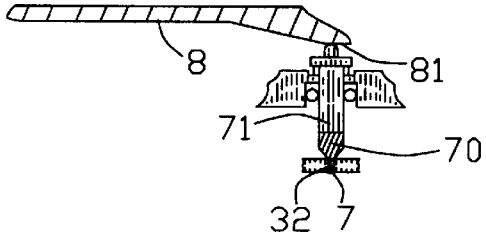

As well as being co-axially movable relative to the cartridge 2, the pins 7, ring 70 and posts 71 are also angularly movable with the cartridge 2 and face plate 3 so that the posts 71 follow the cam track 8 in obtaining required non-operation or operation of the pins 7 in relation to the perforations 32. Thus as shown in FIGS. 3 to 5 each pin 7 is in the inoperative or withdrawn position relative to its corresponding perforation 32 during any of the three showering or spray modes of the handset 1. But in a further or fourth cleaning setting of the cartridge 2 and face plate 3 (FIG. 6), the follower posts 71 co-act with cam formation or ramp 81 of the track 8 to thrust each pin 7 into the operative penetrating position through the perforation 32.

To avoid complete shut off of water admission to the outlets 30, 31 and 32 in the cleaning setting of the cartridge 2 and face plate 3 and so prevent undesired back pressure and possible pump stalling, bleed paths 28 are shown provided in the cartridge 2 from the openings 12 to allow pressure reducing weepage of water to one or more of the outlets 30, 31 or 32.

As will be appreciated from the foregoing cleaning of the fine spray perforations 32 can be carried out as and when required by the user so that unnecessary operation of the pins 7 is avoided whilst the cleaning operation can also be effected quite independently of the showering modes.

Figure 7:
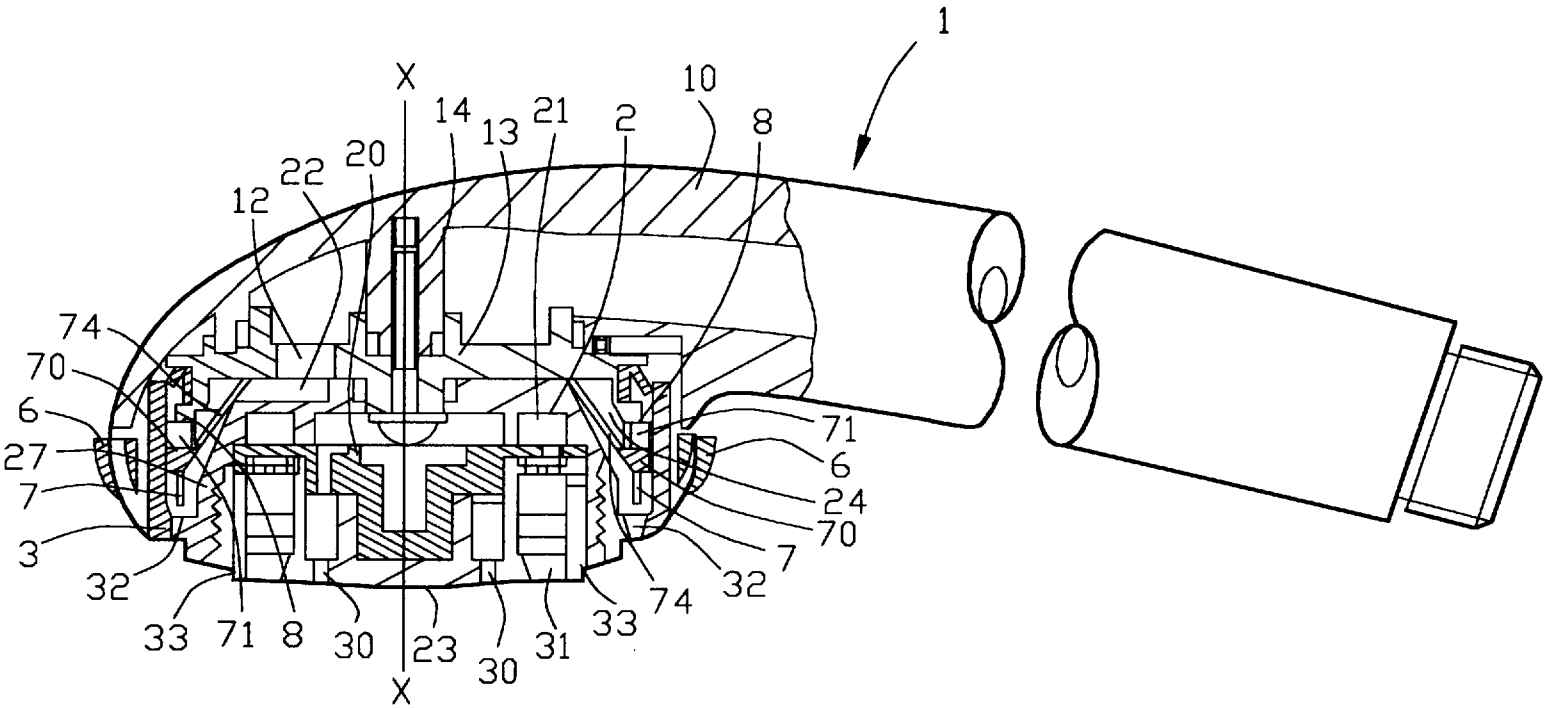
FIG. 7 is a side elevation of a further form of the handset shown in a showering mode and in which the head portion is also shown in section to reveal the internal mechanism.

In the further form of the handset shown in FIG. 7 water under pressure is admitted along the tubular neck or handle 11 of the handset into the head portion 10 where it enters an opening 12 (or openings) in the partition 13 across the interior of the head portion 10. In this instance the partition is provided by a back plate 13 and accommodated against it in the head 10 is the cartridge 2 having a spray plate or ring 3' about it. The cartridge 2 is angularly movable about the central axis X so as to have a valve like co-operation with the opening 12 in relation to chambers or passageways 20, 21 and 22 in the cartridge 2. The spray plate 3' and cartridge 2 are fast or integral with one another and can be together turned about the central securing bolt 4 on the axis X by means of the gripping ring or bezel 6 fast with and about the spray plate 3'.

In this arrangement the cartridge 2 is shown receiving a block or plug 23 co-axially screwed fast therein and containing showering outlets 30 and 31 as later described.

In the foaming or aerated mode setting of the cartridge 2, water from the opening 12 is directed to the annular chamber 21 for passing the water to corresponding outlet openings 31 in the plug 23, the outlet openings 31 being again arranged in an annular manner about the axis X and inner pulse mode outlets 30. As before passage of water to the outlets 31 is such as to draw in air through ducts 33 alongside the outlets 31, which air intermingles with the water to provide an aerated emission of water from the outlets 31 in the foaming mode.

On angular setting of the cartridge 2 to the pulse mode position water from the opening 12 is directed to passageways (one of which is shown at 20) in the plug 23 for emission from the outlet openings 30 at the front of the plug 23, which outlets 30 are centrally arranged in an annular manner on a common circle about the axis X.

In the third or fine spray mode the angular setting of the cartridge 2 and spray plate 3' is such as to direct water from the opening 12 via an annular chamber 22 to the annular arrangement of fine perforations 32 in the spray plate 3'. This setting is actually shown in FIG. 7.

As already mentioned and owing to their fine nature the perforations 32 tend to become blocked or restricted mainly by lime scale deposits from the water, and need to be cleaned by the cleaning pins 7 as and when required. This is achieved by further turning of the cartridge 2 and spray plate 3' beyond the above described showering mode settings.

Each cleaning pin 7 is aligned with a corresponding perforation 32 and in the operative penetrating position has a small clearance fit in the corresponding perforation 32 to dislodge and expel any scale or the like from it in maintaining a satisfactory water spray. The clearance fit enables some water flow to take place through the perforations 32 during penetration by the pins 7 so as to wash away dislodged scale and also avoid or minimise build-up of back pressure in the water supply. The perforations 32 are shown of taper or countersunk form to receive the pins 7.

The series of pins 7 are carried by the ring 70 accommodated in an annular space 24 between the cartridge 2 and spray plate 3' whilst follower projections 71 extending from the rear of the ring 70 co-operate with an annular cam track or profile 8 on and about the back plate 13.

The follower projections 71 (e.g. three) are equi-spaced on the ring 70 and as later described the latter is spring loaded to maintain the projections 71 in contact with the cam track 8 and in a direction tending to withdraw the pins 7 from the perforations 32.

The ring 70 is located between the spray plate 3' and cartridge 2 for turning therewith by operation of the bezel 6 in obtaining required co-operation of the follower projections 71 with the cam track 8.

In FIGS. 8 to 12 a follower projection 71 and corresponding portion of the cam track 8 are respectively shown in the foaming, pulse and spray modes and then in the cleaning and intermediate positions. In the showering settings shown in FIGS. 8 to 10 the follower projection 71 is against a flat portion 80 of the cam track 8 so that each pin 71 is withdrawn clear from its corresponding perforation 32. However in FIG. 11 the follower projection 71 is shown depressed by an inclined portion or ramp 81 of the track 8 so that the ring 70 is thrust downwardly and all the pins 7 caused to enter their respective perforations 32 for cleaning the latter.

Figure 8:
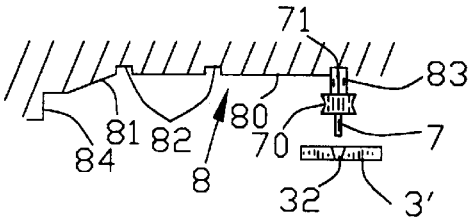
FIGS. 8 to 12 are diagrammatic detail elevational views showing cam co-action of the mechanism of FIG. 7 in the showering modes and cleaning and intermediate positions.
Figure 9:
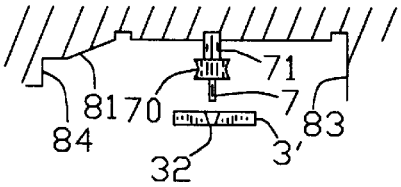
Figure 10:
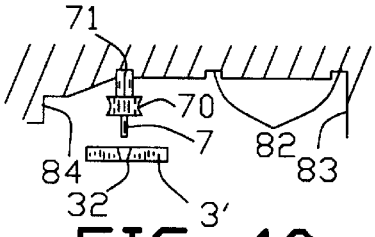
Figure 11:
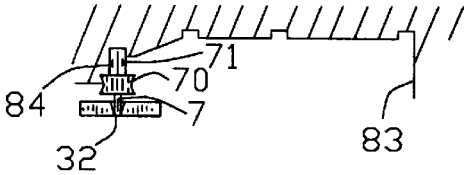
Figure 12:
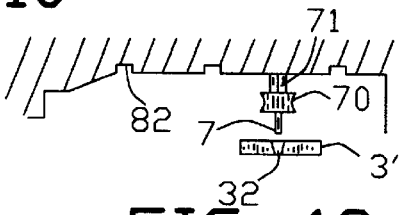

The flat portion 80 of the track 8 is shown locally recessed at 82 to receive the follower 71 with a "click" engagement in order to locate the cartridge 2 in each of the showering modes as will be apparent from FIGS. 8 to 10. A position of the follower 71 intermediate adjacent recesses 82 is shown in FIG. 12.

A particular feature of this form of the handset is the provision of end stops 83, 84 on the cam track 8 against which the follower 71 abuts in positively limiting turning movement of the cartridge 2, spray plate 3' and ring 70 in either direction. Such turning movement can thus be constrained to somewhat less than a full circle e.g. 110°.

Further in accordance with the invention a simple and effective arrangement of spring loading the pin ring 70 and pins 7 away from the perforations 32 is provided and in which the ring 70 is provided with a series of upstanding and mutually inclined resilient blades or fingers 75 which bear against a tapered peripheral portion 27 of the cartridge 2.

The arrangement is such that when the pin ring 70 is depressed by the action of the inclined portion 81 of the cam track 8 the blades 75 are thrust outwardly against their resilience but on the ring 70 co-acting with the flat portion 80 of the cam track, the re-assertion of the blades 75 against the tapered periphery 27 withdraws or lifts the ring 70 and pins 7 away from the spray plate 3' so that the pins disengage the perforations 32. Thus the resilient blades 75 maintain the followers 71 in constant contact with the cam track 8. The blades 75 can be conveniently formed integrally with the pin ring 70 which together with the pins 7 and followers 71 can be produced as a one piece moulding in acetal or other suitable plastic material.

As will be appreciated from the foregoing and again as before cleaning of the fine spray perforations 32 can be carried out as and when required by the user so that unnecessary operation of the pins 7 is avoided. Also the cleaning operation is again effected quite independently of the showering modes. In the particular arrangement indicated in FIGS. 8 to 12 the cleaning position is selected after the showering modes (or before them) but not in between them. Thus a showering mode or any sequence of them can be selected without causing a cleaning operation.

As will also be apparent and in both examples of handset herein described, a simplified form of the mechanism is made possible in the interests of economic manufacture.

We claim:

1. A multi-mode shower head or handset in which a body member or cartridge is secured for relative angular movement to the head and has a valve-like cooperation with the hollow interior of the head for directing water flow from the head via passageways in the cartridge to arrangements of showering mode outlet openings including fine spray outlet openings at the front face of the cartridge, the showering modes from said outlets being selected by turning the cartridge to appropriate settings on the head, and a series of cleaning pins rotatable with the cartridge and coaxially movable relative thereto for cleaning penetration into corresponding fine spray outlet openings and withdrawal therefrom; characterized in that the series of cleaning pins are operated for such co-axial cleaning movement by an arrangement of follower means and a co-operating cam profile or track acting between a carrier member or ring carrying the series of cleaning pins and the head whereby the cleaning pine remain in an inoperative withdrawn position during and between any of the showering mode settings of the cartridge and are only independently operated for cleaning movement by co-action between the follower means and operative cam formation of the cam profile or track on further turning movement of the cartridge beyond its showering mode settings.

2. A multi-mode shower head or handset according to claim 1 wherein the follower means is provided on the carrier member or ring for co-operation with the cam profile or track positioned fast within the head.

3. A multi-mode shower head or handset according to claim 1 wherein the cam profile or track includes provision for location of the cartridge at each of the showering mode settings.

4. A multi-mode shower head or handset according to claim 1 wherein the follower means is arranged to have a locating engagement at locations or recesses along the cam profile or track while the cleaning pins remain inoperative and in order to locate the cartridge at each of the showering mode settings.

5. A multi-mode shower head or handset according to claim 1 wherein cam co-action between the follower means and the cam profile or track is maintained by spring loading.

6. A multi-mode shower head or handset according to claim 1 wherein the spring loading is provided by resilient blades which co-operate with a peripheral portion of the cartridge in order to maintain the cam co-action between the follower means and the cam profile or track.

7. A multi-mode shower head or handset according to claim 1 wherein the extent of angular movement of the cartridge relative to the head is limited by stop means.

8. A multi-mode shower head or handset according to claim 1 wherein the extent of angular movement of the cartridge is limited by end stops of the cam profile or track which are contacted by the follower means at each extreme of angular movement of the cartridge.

9. A multi-mode shower head or handset according to claim 1 wherein the front of the cartridge is provided with a face member or spray plate or ring rotationally fast therewith and containing at least one of the showering outlet openings.

10. A multi-mode shower head or handset according to claim 1 wherein the front of the cartridge receives a block or plug fast therein and containing at least one of the showering outlets.

11. A multi-mode shower head or handset according to claim 1 wherein the fine spray outlet openings are arranged to receive respective cleaning pins with a small clearance fit so as to permit some water flow to take place through the openings during penetration by the pins in order to wash away dislodged scale or the like from the openings.

12. A multi-mode shower head or handset according to claim 1 wherein the fine spray outlet openings are of taper countersunk form to receive respective cleaning pins.

* * * * *